US010887681B1

(12) United States Patent
Wen

(10) Patent No.: US 10,887,681 B1
(45) Date of Patent: Jan. 5, 2021

(54) COMBINATION OF BONE CONDUCTION BLUETOOTH EARPHONE AND CHARGING BASE

(71) Applicant: Transound Electronics Co., Ltd., Dongguan (CN)

(72) Inventor: Tseng-Feng Wen, Dongguan (CN)

(73) Assignee: TRANSOUND ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 16/734,407

(22) Filed: Jan. 6, 2020

(30) Foreign Application Priority Data

Aug. 12, 2019 (CN) ..... 2019 2 1298187 U

(51) Int. Cl.
*H04R 1/10* (2006.01)

(52) U.S. Cl.
CPC ..... *H04R 1/1016* (2013.01); *H04R 1/1025* (2013.01); *H04R 1/1041* (2013.01); *H04R 1/1075* (2013.01); *H04R 2420/07* (2013.01); *H04R 2420/09* (2013.01); *H04R 2460/13* (2013.01)

(58) Field of Classification Search
CPC ..... H04R 1/10
See application file for complete search history.

(56) References Cited

U.S. PATENT DOCUMENTS

| | | | | |
|---|---|---|---|---|
| 7,792,552 | B2 * | 9/2010 | Thomas | G02C 11/06 455/556.1 |
| 9,014,403 | B2 * | 4/2015 | Miyoshi | H04R 15/00 381/152 |
| 10,284,982 | B1 * | 5/2019 | Lewin Jessen | H04R 1/1091 |
| 2005/0286734 | A1 * | 12/2005 | Wang | H04R 25/604 381/381 |
| 2009/0304209 | A1 * | 12/2009 | Nakatani | H04R 1/1075 381/151 |
| 2010/0098286 | A1 * | 4/2010 | Giese | H04R 25/456 381/380 |
| 2013/0121513 | A1 * | 5/2013 | Adachi | H04R 11/02 381/151 |
| 2014/0232981 | A1 * | 8/2014 | Sugihara | G02B 27/0176 351/158 |
| 2014/0348346 | A1 * | 11/2014 | Fukuda | H04R 1/1016 381/151 |
| 2016/0246076 | A1 * | 8/2016 | Wei | G02C 5/12 |
| 2017/0223445 | A1 * | 8/2017 | Bullen | G06F 3/165 |
| 2019/0327543 | A1 * | 10/2019 | Ogata | H04R 1/1075 |
| 2020/0073148 | A1 * | 3/2020 | Alhaideri | G02C 7/101 |

* cited by examiner

*Primary Examiner* — Olisa Anwah
(74) *Attorney, Agent, or Firm* — Leong C. Lei

(57) ABSTRACT

A combination of a bone conduction Bluetooth earphone and a charging base includes an earphone body, a PCB, a wireless module, and a rechargeable battery. The PCB, the wireless module and the rechargeable battery are disposed in the earphone body. The wireless module and the rechargeable battery are electrically connected to the PCB. It realizes the design of the bone conduction Bluetooth earphone and solves the problem that an air conduction speaker needs good air tightness, a resonant chamber and tuning and is inconvenient for assembly. The structural design is clever and reasonable, and it is easy for production.

9 Claims, 4 Drawing Sheets

COMBINATION OF BONE CONDUCTION BLUETOOTH EARPHONE AND CHARGING BASE

BACKGROUND OF THE INVENTION

1. Field of the Invention

The present invention relates to an earphone, and more particularly to a combination of a bone conduction Bluetooth earphone and a charging base.

2. Description of the Prior Art

Most TWS earphones use air conduction speakers. Air conduction speakers need sound outlets for sound wave conduction, in cooperation with the space of a sound chamber to adjust the frequency response curve of the earphone by using a tuning net/tuning paper, etc. In this way, the assembly may be affected by many uncertain factors, such as poor glue control, poor air tightness, and difficult assembly.

Accordingly, the inventor of the present invention has devoted himself based on his many years of practical experiences to solve these problems.

SUMMARY OF THE INVENTION

In view of the shortcomings of the prior art, the primary object of the present invention is to provide a combination of a bone conduction Bluetooth earphone and a charging base, which realizes the design of the bone conduction Bluetooth earphone and solves the problem that an air conduction speaker needs good air tightness, a resonant chamber and tuning and is inconvenient for assembly. The structural design is clever and reasonable, and it is easy for production.

In order to achieve the above object, the present invention adopts the following technical solutions:

According to one aspect of the present invention, a bone conduction Bluetooth earphone is provided. The bone conduction Bluetooth earphone comprises an earphone body, a PCB (printed circuit board), a wireless module, and a rechargeable battery. The PCB, the wireless module and the rechargeable battery are disposed in the earphone body. The wireless module and the rechargeable battery are electrically connected to the PCB. A bone conduction speaker module is provided in the earphone body. The bone conduction speaker module is electrically connected to the PCB.

The earphone body includes a body portion and a casing connected to the body portion. The body portion has a first mounting chamber. The casing has a second mounting chamber. The first mounting chamber and the second mounting chamber communicate with each other. The PCB and the wireless module are installed in the first mounting chamber. The rechargeable battery and the bone conduction speaker module are installed in the second mounting chamber.

According to another aspect of the present invention, a combination of the above-mentioned bone conduction Bluetooth earphone and a charging base is provided. The charging base is provided with a power output port. The earphone body of the bone conduction Bluetooth earphone is provided with a charging interface. The charging interface is fitted to the power output port.

Compared with the prior art, the present invention has obvious advantages and beneficial effects. Specifically, it can be known from the foregoing technical solutions. The earphone body is provided with the PCB, the wireless module, the rechargeable battery and the bone conduction speaker module to realize the design of the bone conduction Bluetooth earphone. It solves the problem that the air conduction speaker needs good air tightness, a resonant chamber and tuning and is inconvenient for assembly. The present invention has an ingenious structure design and a reasonable component layout and is easy for production.

Secondly, through the combined design of the bone conduction Bluetooth earphones and the charging base, the present invention has detachable charging performance.

Furthermore, the charging base is provided with the flip cover, so that the charging base can cover the accommodating chamber in a hidden manner and prevent debris from falling into the accommodating chamber. In addition, the charging base is equivalent to a portable base of the earphone. The flip cover is closed to hide the earphone in the base so as to protect and carry the earphone.

DETAILED DESCRIPTION OF THE PREFERRED EMBODIMENTS

Figure 1:
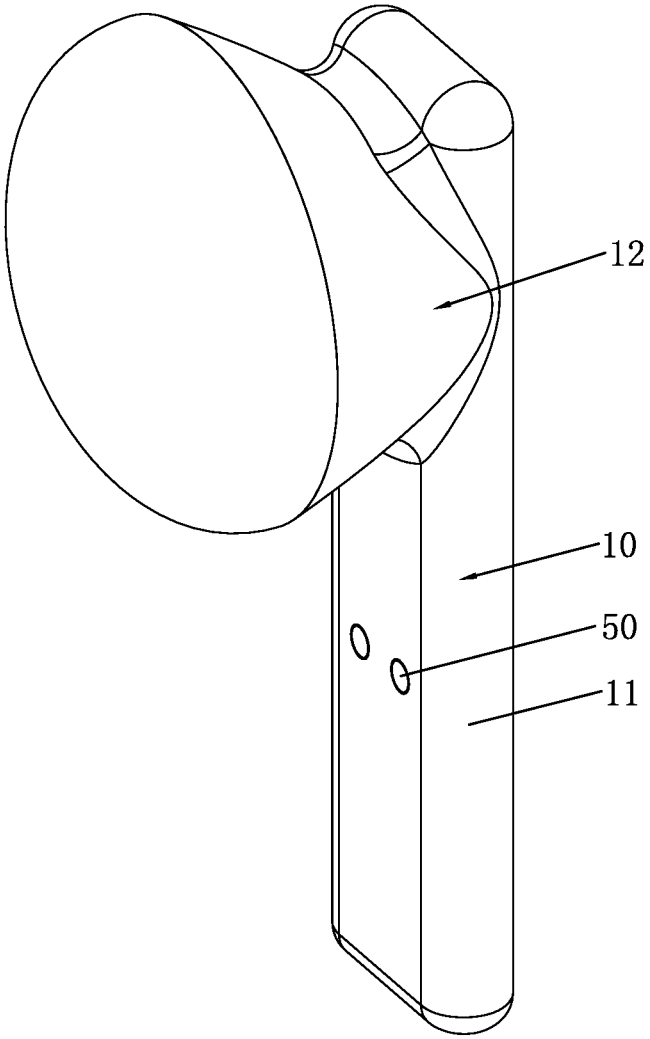
FIG. 1 is a perspective view of the bone conduction Bluetooth earphone according to a preferred embodiment of the present invention.
Figure 2:
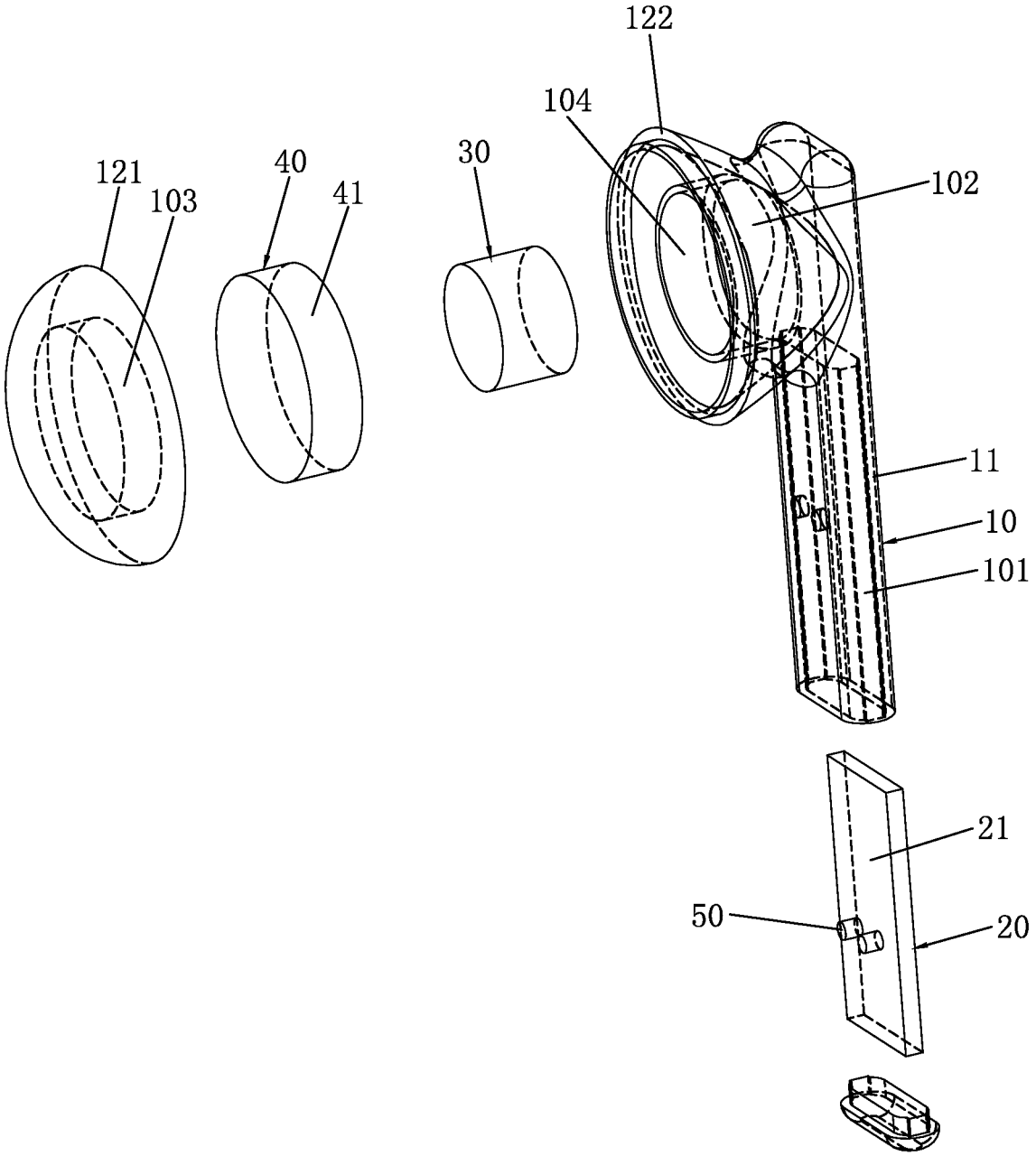
FIG. 2 is an exploded view of the bone conduction Bluetooth earphone according to the preferred embodiment of the present invention.
Figure 3:
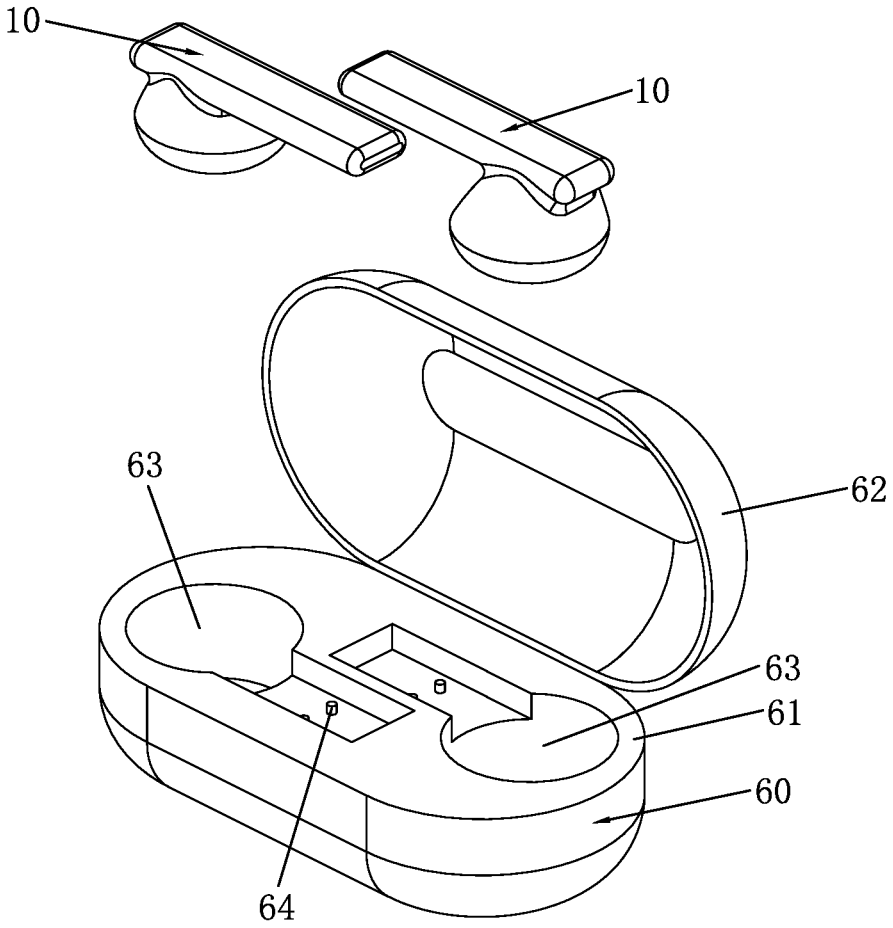
FIG. 3 is an exploded view of the bone conduction Bluetooth earphone according to the preferred embodiment of the present invention combined with the charging base.
Figure 4:
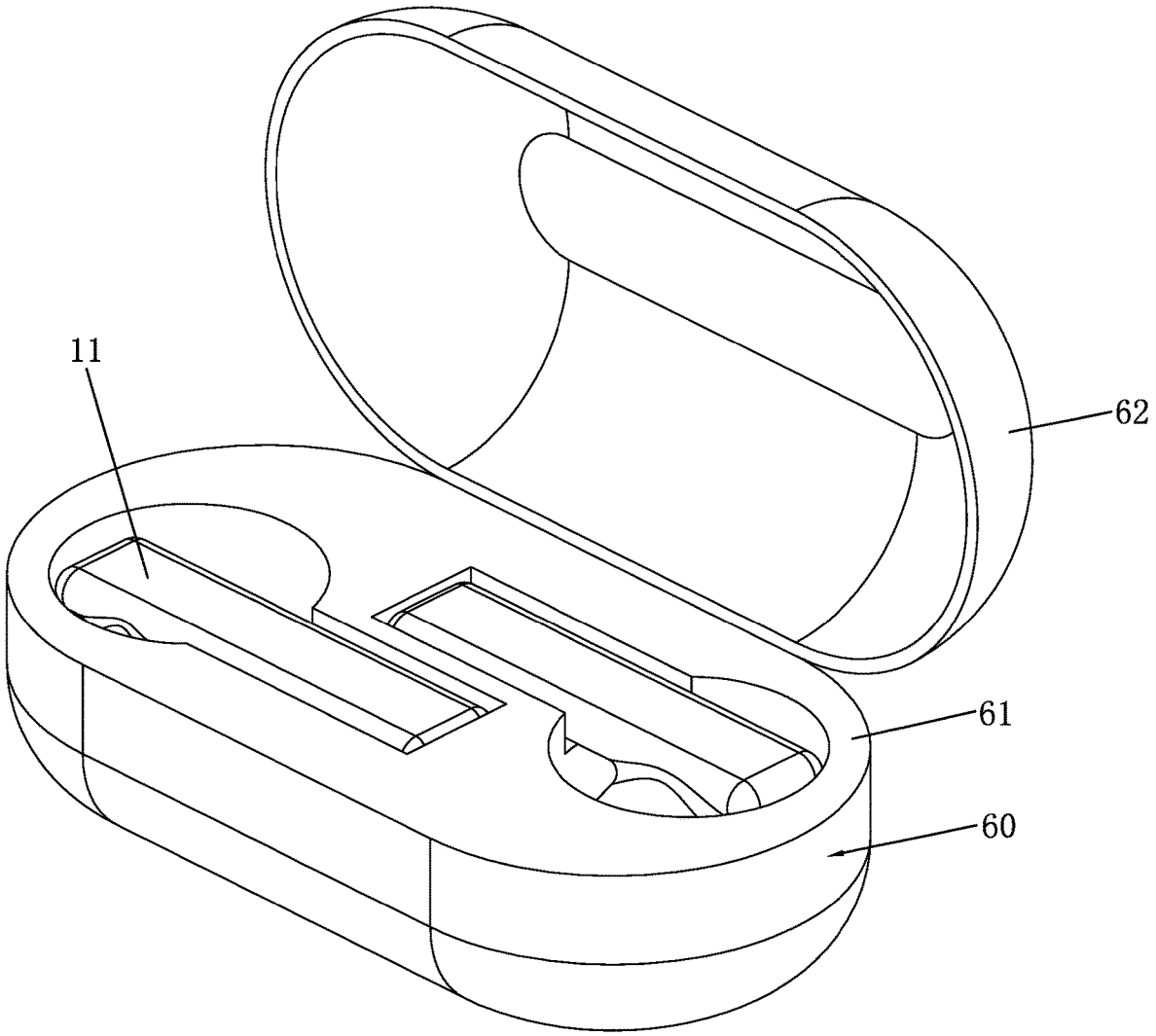
FIG. 4 is a perspective view of the bone conduction Bluetooth earphone according to the preferred embodiment of the present invention combined with the charging base.

Please refer to FIG. 1 to FIG. 4, which show the specific structure of an embodiment of the present invention. The present invention is mainly applied to in-ear TWS true wireless Bluetooth earphones. Of course, it is not limited to the application of the TWS true wireless Bluetooth earphones. It can be applied to other Bluetooth earphones, wireless earphones, headphones or other earphones, and can also be used on hearing aids to assist people with disabilities.

First of all, it should be noted that in the following description, the orientations or positional relationships indicated by some terms "front", "rear", etc. are based on the orientations or positional relationships shown in the figures. It is only for the convenience of describing the technical solution and simplified description of the present invention, and does not indicate or imply that the device or element referred to must have a specific orientation or be structured and operated in a specific orientation. Therefore, it cannot be understood as a limitation on the present invention.

A bone conduction Bluetooth earphone comprises an earphone body 10, a PCB (printed circuit board) 20, a wireless module 21, and a rechargeable battery 30. The PCB 20, the wireless module 21 and the rechargeable battery 30 are disposed in the earphone body 10. The wireless module 21 and the rechargeable battery 30 are electrically connected to the PCB 20. A bone conduction speaker module 40 is provided in the earphone body 10. The bone conduction speaker module 40 is electrically connected to the PCB 20. The bone conduction speaker module 40 includes a bone conduction oscillator 41. The bone conduction oscillator 41 is electrically connected to the PCB 20.

Specifically, the earphone body 10 includes a body portion 11 and a casing 12 connected to the body portion 11. The body portion 11 has a first mounting chamber 101. The casing 12 has a second mounting chamber 102. The first mounting chamber 101 and the second mounting chamber 102 communicate with each other. The PCB 20 and the wireless module 21 are installed in the first mounting chamber 101. The rechargeable battery 30 and the bone conduction speaker module 40 are installed in the second mounting chamber 102.

The casing 12 includes a front casing 121 and a rear casing 122 connected to the front casing 121. The front casing 121 has a front chamber 103. The rear casing 122 has a rear chamber 104. The front chamber 103 and the rear chamber 104 jointly define the second mounting chamber 102. The rear casing 122 is connected to the body portion 11. One end of the rear casing 122 is integrally connected to one end of the body portion 11. The front casing 121 is detachably connected to the other end of the rear casing 122. Preferably, the front casing 121 is a silicone casing, so that the front casing 121 is a soft casing made of a soft material. The front casing 121 may be a plastic casing, not limited to the silicone casing.

In addition, the rechargeable battery 30 and the bone conduction speaker module 40 are sequentially installed into the second mounting chamber 102 from front to back. The rechargeable battery 30 is located behind the bone conduction speaker module 40.

The earphone body 10 is provided with a charging interface 50. The charging interface 50 is electrically connected to the PCB 20. The charging interface 50 is exposed and disposed on one side of the earphone body 10. The charging interface 50 is disposed on the side wall of the body portion 11. Preferably, the charging interface 50 is a contact interface or a USB interface. Of course, it may be other interfaces, as long as it is able to charge the internal rechargeable battery 30, which will not be described here.

The present invention further provides a combination of the bone conduction Bluetooth earphones and a charging base 60. The charging base 60 is provided with a power output port 64. The charging interface 50 on the earphone body 10 of the bone conduction Bluetooth earphone is fitted to the power output port 64.

The charging base 60 is provided with an accommodating chamber 63. The earphone body 10 is detachably fitted in the accommodating chamber 63. The power output port 64 is disposed in the accommodating chamber 63 so that the power output port 64 is concealed, so as to avoid the phenomenon that the power output port 64 is exposed outside the charging base 60 and is easily damaged. Specifically, the charging base 60 includes a base 61 and a flip cover 62 connected to the base 61. The accommodating chamber 63 is disposed on the base 61. The flip cover 62 can selectively cover or uncover the opening of the accommodating chamber 63, so that the charging base 60 can cover the accommodating chamber 63 in a hidden manner to prevent debris from falling into the accommodating chamber 63. In addition, the charging base 60 is equivalent to a portable base of the earphone. The earphone can be placed in the accommodating chamber 63, the charging interface 30 is plugged into the power output port 64, and then the flip cover 62 is closed to hide the earphone in the base 61 so as to protect and carry the earphone.

In summary, the feature of the present invention is that the earphone body is provided with the PCB, the wireless module, the rechargeable battery and the bone conduction speaker module to realize the design of the bone conduction Bluetooth earphone. It solves the problem that the air conduction speaker needs good air tightness, a resonant chamber and tuning and is inconvenient for assembly. The present invention has an ingenious structure design and a reasonable component layout and is easy for production. Secondly, through the combined design of the bone conduction Bluetooth earphones and the charging base, the present invention has detachable charging performance. Furthermore, the charging base is provided with the flip cover, so that the charging base can cover the accommodating chamber in a hidden manner and prevent debris from falling into the accommodating chamber. In addition, the charging base is equivalent to a portable base of the earphone. The flip cover is closed to hide the earphone in the base so as to protect and carry the earphone.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A bone conduction Bluetooth earphone, comprising an earphone body, a PCB (printed circuit board), a wireless module and a rechargeable battery; the PCB, the wireless module and the rechargeable battery being disposed in the earphone body; the wireless module and the rechargeable battery being electrically connected to the PCB; a bone conduction speaker module being provided in the earphone body, the bone conduction speaker module being electrically connected to the PCB;

the earphone body including a body portion and a casing connected to the body portion, the body portion having a first mounting chamber, the casing having a second mounting chamber, the first mounting chamber and the second mounting chamber communicating with each other, the PCB and the wireless module being installed in the first mounting chamber, the rechargeable battery and the bone conduction speaker module being installed in the second mounting chamber;

wherein the casing includes a front casing and a rear casing connected to the front casing, the front casing has a front chamber, the rear casing has a rear chamber, the front chamber and the rear chamber jointly define the second mounting chamber, and the rear casing is connected to the body portion.

2. The bone conduction Bluetooth earphone as claimed in claim 1, wherein one end of the rear casing is integrally connected to one end of the body portion, and the front casing is detachably connected to another end of the rear casing.

3. The bone conduction Bluetooth earphone as claimed in claim 1, wherein the front casing is one of a silicone casing and a plastic casing.

4. The bone conduction Bluetooth earphone as claimed in claim 1, wherein the rechargeable battery and the bone conduction speaker module are sequentially installed into the second mounting chamber from front to back, and the rechargeable battery is located behind the bone conduction speaker module.

5. The bone conduction Bluetooth earphone as claimed in claim 1, wherein the bone conduction speaker module includes a bone conduction oscillator, and the bone conduction oscillator is electrically connected to the PCB.

6. The bone conduction Bluetooth earphone as claimed in claim 1, wherein the earphone body is provided with a charging interface, the charging interface is electrically connected to the PCB, and the charging interface is exposed and disposed on one side of the earphone body.

7. A combination of the bone conduction Bluetooth earphone as claimed in claim 1 and a charging base, the charging base being provided with a power output port, the earphone body of the bone conduction Bluetooth earphone being provided with a charging interface, the charging interface being fitted to the power output port.

8. The combination of the bone conduction Bluetooth earphone and the charging base as claimed in claim 7, wherein the charging base is provided with an accommodating chamber, the earphone body is detachably fitted in the accommodating chamber, and the power output port is disposed in the accommodating chamber.

9. The combination of the bone conduction Bluetooth earphone and the charging base as claimed in claim 8, wherein the charging base includes a base and a flip cover connected to the base, the accommodating chamber is disposed on the base, and the flip cover selectively covers or uncovers an opening of the accommodating chamber.

* * * * *